US006611997B1

(12) United States Patent
Savicki

(10) Patent No.: US 6,611,997 B1
(45) Date of Patent: Sep. 2, 2003

(54) CLOSURE DEVICE

(75) Inventor: Alan F. Savicki, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/979,392

(22) PCT Filed: Jun. 10, 1999

(86) PCT No.: PCT/US99/13130

§ 371 (c)(1),
(2), (4) Date: Nov. 13, 2001

(87) PCT Pub. No.: WO00/76348

PCT Pub. Date: Dec. 21, 2000

(51) Int. Cl.[7] ..... A44B 19/16
(52) U.S. Cl. ..... 24/400; 24/30.5 R
(58) Field of Search ..... 24/30.5 R, 30.5 P, 24/415, 585.12, 500, 507, 499, 3.12, 3.11; 383/63, 64, 65, 66

(56) References Cited

U.S. PATENT DOCUMENTS

| | | | | |
|---|---|---|---|---|
| 3,579,747 A | | 5/1971 | Hawley | |
| 4,199,845 A | | 4/1980 | Ausnit | |
| 4,829,641 A | | 5/1989 | Williams | |
| 5,007,142 A | | 4/1991 | Herrington | |
| 5,007,143 A | | 4/1991 | Herrington | |
| 5,010,627 A | | 4/1991 | Herrington et al. | |
| 5,020,194 A | | 6/1991 | Herrington et al. | |
| 5,063,644 A | * | 11/1991 | Herrington et al. | 24/400 |
| 5,067,208 A | * | 11/1991 | Herrington, Jr. et al. | 24/400 |
| 5,070,583 A | | 12/1991 | Herrington | |
| 5,283,932 A | | 2/1994 | Richardson et al. | |
| 5,301,394 A | | 4/1994 | Richardson et al. | |
| 5,426,830 A | | 6/1995 | Richardson et al. | |
| 5,431,760 A | | 7/1995 | Donovan | |
| 5,442,838 A | | 8/1995 | Richardson et al. | |
| 5,448,808 A | * | 9/1995 | Gross | 24/400 |
| 5,836,056 A | | 11/1998 | Porchia et al. | |
| 5,867,875 A | * | 2/1999 | Beck et al. | 24/400 |
| 5,896,627 A | * | 4/1999 | Cappel et al. | 24/400 |

* cited by examiner

*Primary Examiner*—Robert J. Sandy
(74) *Attorney, Agent, or Firm*—Thomas C. Feix

(57) ABSTRACT

A multi-piece slider member (150) is provided for use with interlocking fastening strips (120, 130). The slider member (150) is slidably disposed upon the interlocking fastening strips (120, 130) to facilitate the occlusion and deocclusion of the fastening strips when moved towards first and second ends thereof. The slider member (150) comprises a first housing segment (160), a second housing segment (170), and an attachment mechanism (200) for use in assembling the first and second housing segments together onto the interlocking fastening strips (120, 130). The attachment mechanism (200) includes an appendage (210) projecting from the first housing segment and a cooperating slot (250) formed in the second housing segment. The appendage (210) has a barb (212) formed along the length while the slot (250) has a notch (252) formed along its length. When the first and second housing segments (160, 170) are moved together during assembly, the slot (250) receives the appendage (210) while the barb (212) interacts with the notch (252) to provide at least one assembly position for the first and second housing segments (160, 170).

84 Claims, 10 Drawing Sheets

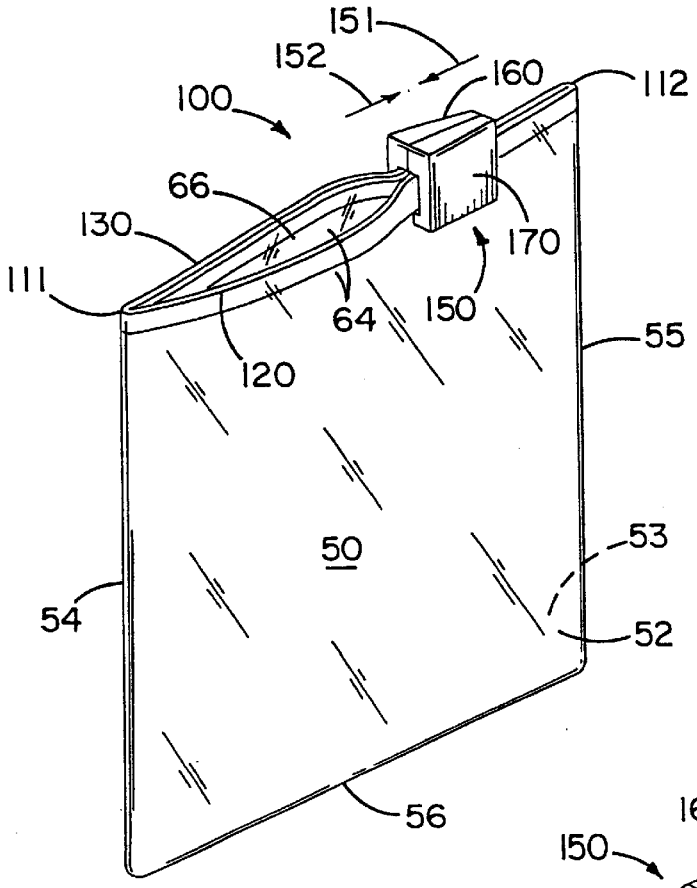
FIG. 1
FIG. 2
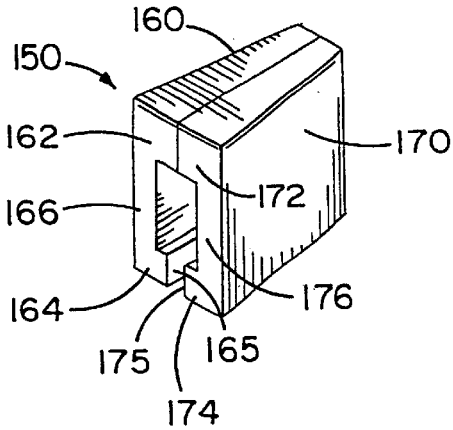
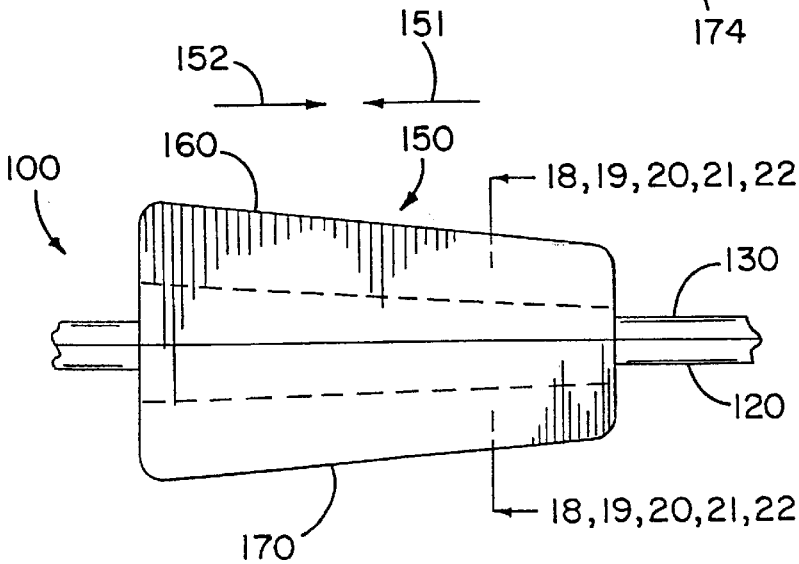
FIG. 3

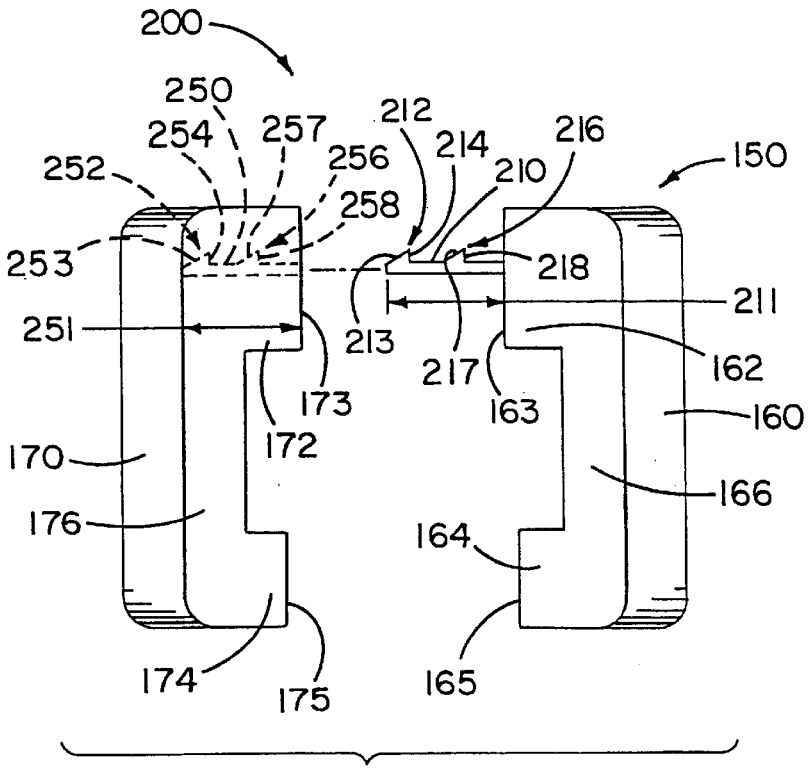
FIG. 4
FIG. 5
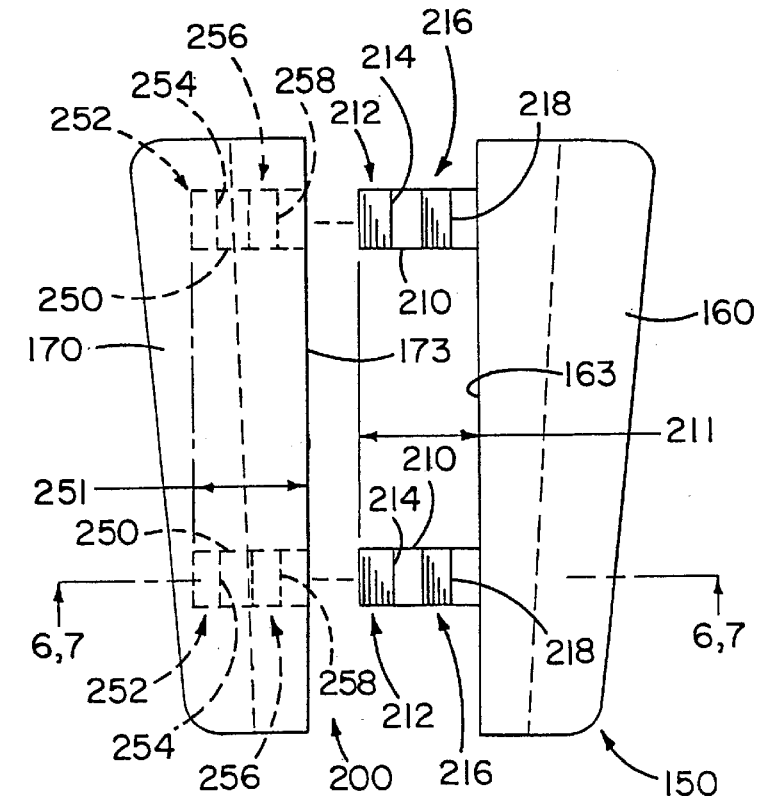

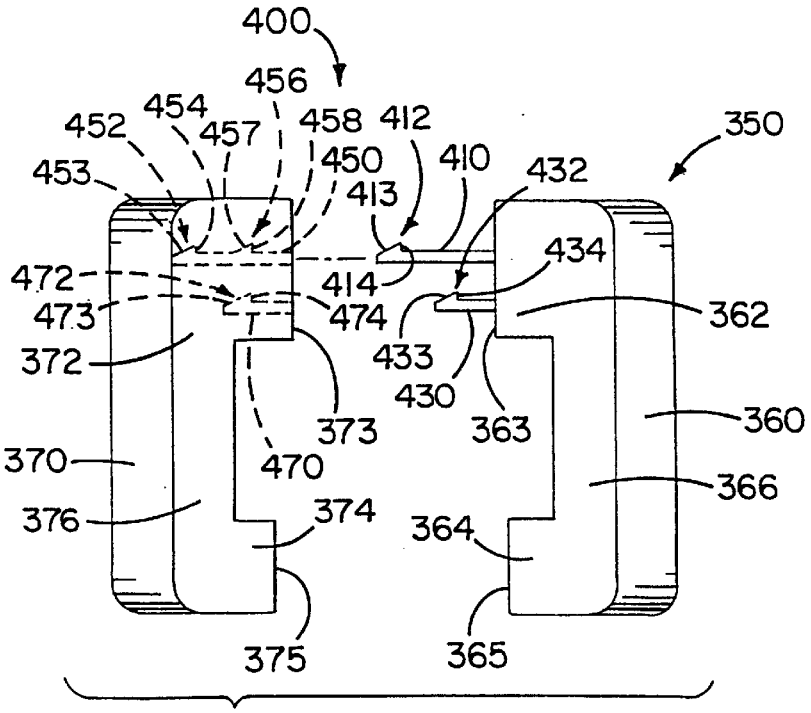
FIG. 8
FIG. 9
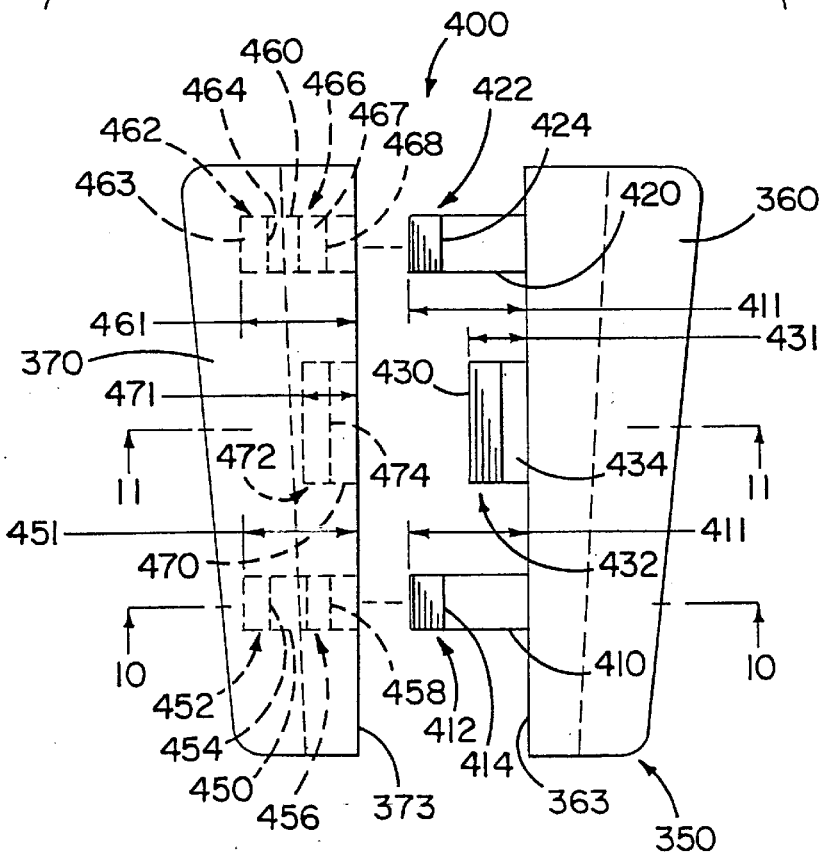

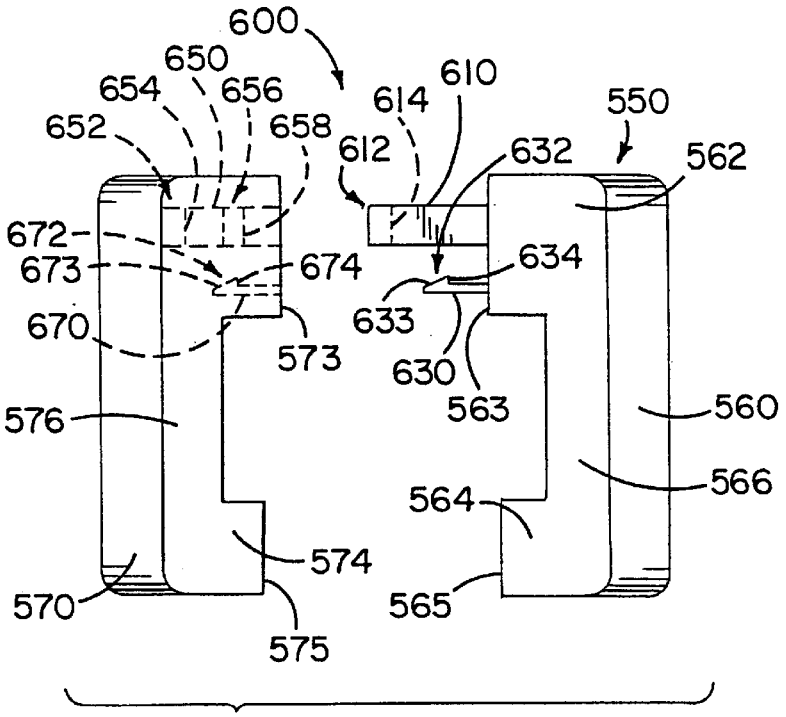
FIG. 12
FIG. 13
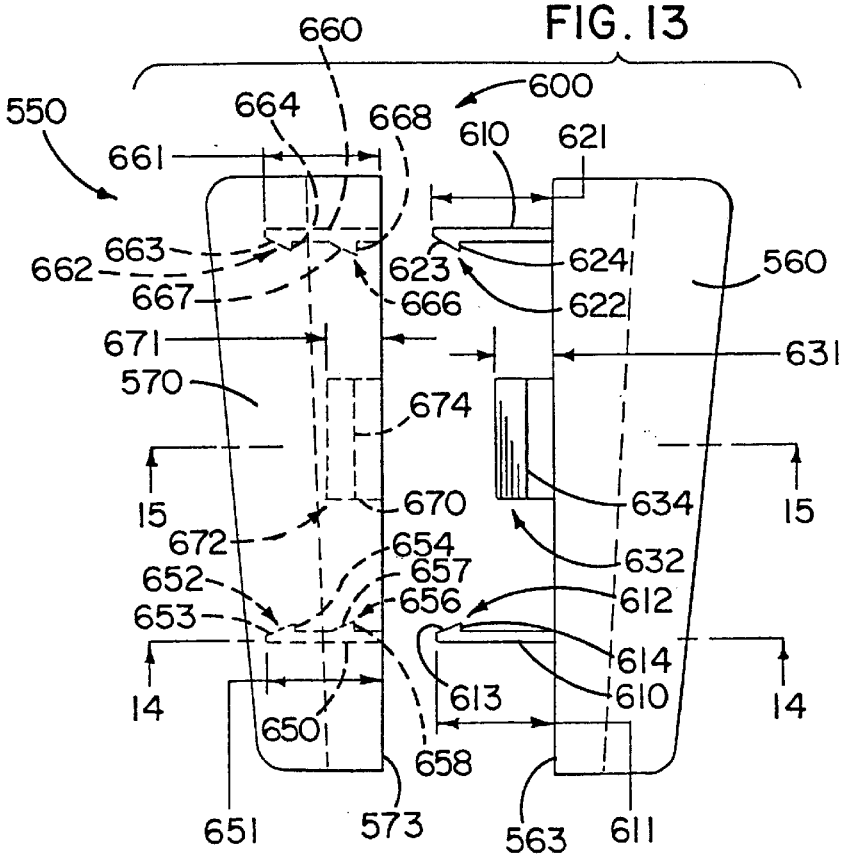

CLOSURE DEVICE

FIELD OF THE INVENTION

The present invention relates generally to closure devices and, more particularly, to a closure device having interlocking fastening strips, a slider member comprised of first and second housing segments, and an attachment mechanism for use in assembling the first and second housing segments together onto the interlocking fastening strips. The inventive closure device may be employed in traditional fastener areas and is particularly well suited for fastening flexible storage containers, such as plastic bags.

BACKGROUND OF THE INVENTION

The use of closure devices for fastening storage containers, including plastic bags, is generally well known. Furthermore, the manufacture of closure devices made of plastic materials is generally well known to those skilled in the art, as demonstrated by the numerous patents in this area.

A particularly well-known use for closure devices is in connection with flexible storage containers, such as plastic bags. Such closure devices provide a convenient way to close the bag in order to retain matter therein. Conventional closure devices typically utilize mating fastening strips which are used to selectively seal the bag. With such closure devices, however, it is often difficult to determine whether the fastening strips are fully occluded. This problem is particularly acute when the fastening strips are relatively narrow. Accordingly, when such fastening strips are employed, there exists a reasonable likelihood that the closure device is at least partially open.

Such fastening strips are particularly difficult to manipulate or handle by individuals with limited manual dexterity. Thus, in order to assist these individuals and for ease of use by individuals with normal dexterity, the prior art has provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Some of these sliders include a separator finger which extends at least partially between the fastening strips. When the slider is moved in the appropriate direction, the separator finger divides the fastening strips and opens and the bag.

While the use of a slider certainly facilitates the opening and closing of fastening strips, there are inherent difficulties involved with installing and assembling the slider onto the fastening strips and with retaining the slider thereon. In an attempt to rectify some of these difficulties, the prior art has provided both single-piece sliders, as disclosed in U.S. Pat. Nos. 5,067,208, 5,070,583, and 5,448,808, and multi-piece sliders, as disclosed in U.S. Pat. Nos. 5,007,142, 5,283,932, and 5,426,830.

The single-piece sliders are disclosed in U.S. Pat. Nos. 5,067,208, 5,070,583, and 5,448,808. Such single-piece sliders suffer from deficiencies including, for example, a complex construction and a relatively high assembly cost. The multi-piece sliders are disclosed in U.S. Pat. Nos. 5,007,142 and 5,426,830. These multi-piece sliders suffer from deficiencies including, for example, a relatively complex construction, a high relative cost, a multiplicity of loose pieces which are subject to misplacement and loss, and a relatively difficult installation upon and assembly onto the fastening strips.

OBJECTS OF THE INVENTION

Accordingly, a general object of the present invention is to provide a slider member for closure devices which overcomes the deficiencies of the prior art.

A more specific object of the present invention is to provide a multi-piece slider member for closure devices which is easily installed upon and assembled onto interlocking fastening strips.

A further object of the present invention is to provide a multi-piece slider member for closure devices which is partially pre-assembled to provide ease of handling and to facilitate its installation upon and assembly onto interlocking fastening strips.

A related object of the present invention is to provide a multi-piece slider member for closure devices which has a multiplicity of assembly positions to facilitate its installation upon and assembly onto interlocking fastening strips.

Another object of the present invention is to provide a multi-piece slider member which is partially pre-assembled and which is conveniently handled as a single unit during its installation upon and assembly onto interlocking fastening strips.

Yet another object of the present invention is to provide a multi-piece slider member for closure devices which has a relatively simple construction.

An additional object of the present invention is to provide a multi-piece slider member for closure devices which is relatively inexpensive to manufacture.

Still another object of the present invention is to provide a multi-piece slider member for closure devices having the foregoing features which is reliable, durable, and convenient to use.

SUMMARY OF THE INVENTION

Accordingly, a multi-piece slider member is provided for a closure device having interlocking fastening strips disposed along opposing side walls of a storage container, such as a conventional plastic bag. The slider member is slidably disposed upon the interlocking fastening strips to facilitate the occlusion and deocclusion of the fastening strips when moved towards first and second ends thereof. The inventive slider member comprises a first housing segment, a second housing segment, and an attachment mechanism for use in assembling the first and second housing segments together onto the interlocking fastening strips. The attachment mechanism includes at least one appendage projecting from the first housing segment and at least one cooperating slot formed in the second housing segment. The appendage(s) have at least one barb formed along their length and the slot(s) have at least one notch formed along their length. When the first and second housing segments are moved together during assembly, the slot(s) of the attachment mechanism receive the appendage(s) of the attachment mechanism while the barb(s) of the appendage(s) interact with the notch(es) of the slot(s) to provide at least one assembly position for the first and second housing segments.

These and other objects, features, and advantages of the present invention will become more readily apparent upon reading the following detailed description of the illustrated embodiments and upon reference to the accompanying drawings wherein:

BRIEF DESCRIPTION OF THE DRAWINGS

FIG. 1 is a perspective view of a storage container in the form of a plastic bag utilizing a closure device comprised of interlocking fastening strips and a slider member constructed in accordance with the present invention;

FIG. 2 is an enlarged perspective view of the slider member depicted in FIG. 1;

FIG. 3 is an enlarged top plan view of the slider member and the interlocking fastening strips depicted in FIG. 1;

FIG. 4 is a rear end view of the slider member depicted in FIG. 2, but showing the two housing segments of the slider member in an unassembled position and showing a first embodiment of an attachment mechanism for use in assembling the two housing segments together onto the interlocking fastening strips;

FIG. 5 is a top plan view of the slider member depicted in FIG. 4;

FIG. 8 is a rear end view of another embodiment of the slider member showing the two housing segments of the slider member in an unassembled position and showing a second embodiment of the attachment mechanism;

FIG. 9 is a top plan view of the slider member depicted in FIG. 8;

FIG. 12 is a rear end view of another embodiment of the slider member showing the two housing segments of the slider member in an unassembled position and showing a third embodiment of the attachment mechanism;

FIG. 13 is a top plan view of the slider member depicted in FIG. 12;

Figure 6:
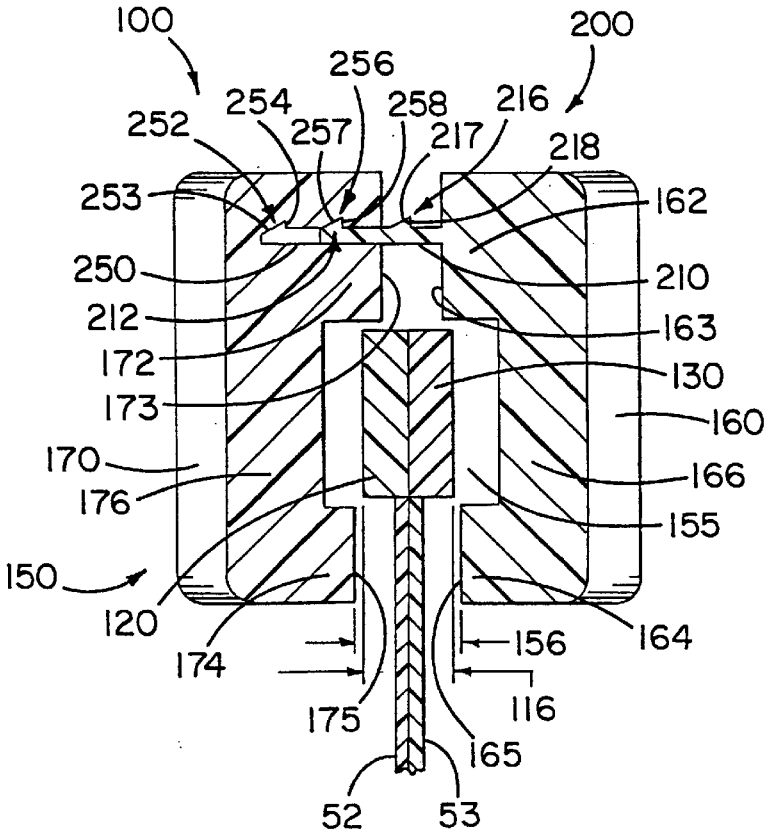
FIG. 6 is a cross-sectional view taken along line 6—6 in FIG. 4, but showing the first and second housing segments of the slider member in a first assembly position upon the interlocking fastening strips.

While the present invention will be described and disclosed in connection with certain embodiments and procedures, the intent is not to limit the invention to these particular embodiments and procedures. On the contrary, the intent is to cover all such alternatives, modifications, and equivalents that fall within the spirit and scope of the present invention as defined by the appended claims.

DETAILED DESCRIPTION OF THE ILLUSTRATED EMBODIMENTS

Turning now to the drawings, a closure device constructed in accordance with the present invention is generally designated by reference numeral 100. As best shown in FIG. 1, the closure device 100 is intended for use with a storage container 50, such as a conventional plastic bag. As is customary in the art, the storage container or bag 50 includes a pair of complementary sheets or opposing flexible side walls 52, 53 which are attached at lateral sides 54, 55 and bottom 56 to form a storage compartment. The complementary sidewalls 52, 53 are also unattached at upper edge portions 64 to form a mouth 66 for the storage container 50. Although a rectangularly-shaped storage container or bag 50 is specifically illustrated herein, it will be readily appreciated by those skilled in the art that other bag shapes may alternatively be used without departing from the scope or spirit of the present invention.

As shown in FIG. 1, the closure device 100 includes a pair of interlocking fastening strips 120, 130 which are disposed along the upper edge portions 64 of the opposing side walls 52, 53. The closure device 100 also includes a slider member 150 which is carried by the two fastening strips 120, 130. More specifically, the first fastening strip 120 is attached to the upper edge portion 64 of one of the side wall 52, the second fastening strip 130 is attached to the upper edge portion 64 of the other side wall 53, and the inventive slider member 150 straddles the first and second fastening strips 120 and 130.

As will be described in greater detail below, the interlocking fastening strips 120, 130 may be of virtually any type, kind, version, or form including, for example: (1) U-channel fastening strips as shown herein at FIG. 18; (2) shear action or Z-axis fastening strips as shown herein at FIG. 19; (3) arrowhead-type fastening strips, as disclosed in U.S. Pat. Nos. 3,198,228 (which reissued as Re. 28,969), 4,736,496, and 5,363,540 and as shown herein at FIG. 20; (4) rolling action fastening strips, as disclosed in U.S. Pat. No. 5,007,143 and as shown herein at FIG. 21; and/or (5) profile fastening strips, as disclosed in U.S. Pat. No. 5,664, 299 and as shown herein at FIG. 22. All of the above-identified patents and applications are hereby incorporated by reference in their entireties.

In operation, the inventive slider member 150 facilitates the occlusion and deocclusion of the interlocking fastening strips 120, 130 when moved in the appropriate direction along the fastening strips. In particular, the slider member 150 facilitates the occlusion of the fastening strips 120, 130 when moved towards a first end 111 thereof, and facilitates the deocclusion of the fastening strips when moved towards a second end 112 thereof. In other words, when the slider 150 is moved in an occlusion direction, as indicated by reference numeral 151 in FIGS. 1 and 3, it facilitates the closure of the fastening strips 120, 103, and when the slider 150 is moved in a deocclusion direction, as indicated by reference numeral 152, it facilitates the separation of the fastening strips. The first and second ends 111 and 112 of the interlocking fastening strips correspond to, and are aligned with, the two lateral sides 54, 55 of the complementary sheets or opposing side walls 52, 53. In addition, when the interlocking fastening strips are occluded, as depicted, for example, in FIGS. 6–7 they have a collective width which is indicated by reference numeral 116.

As shown in FIGS. 1–7, the inventive slider member 150 comprises first and second housing segments 160 and 170 which have substantially complementary configurations and are formed from separate pieces of suitable plastic material. More specifically, the first housing segment 160 includes a top portion 162 with a face 163, a bottom portion 164 with a shoulder 165, and an intermediate side portion 166 arranged between the top and bottom portions 162 and 164. Likewise, the second housing segment 170 includes a top portion 172 with a face 173, a bottom portion 174 with a shoulder 175, and an intermediate side portion 176 arranged between the top and bottom portions 172 and 174.

Figure 20:
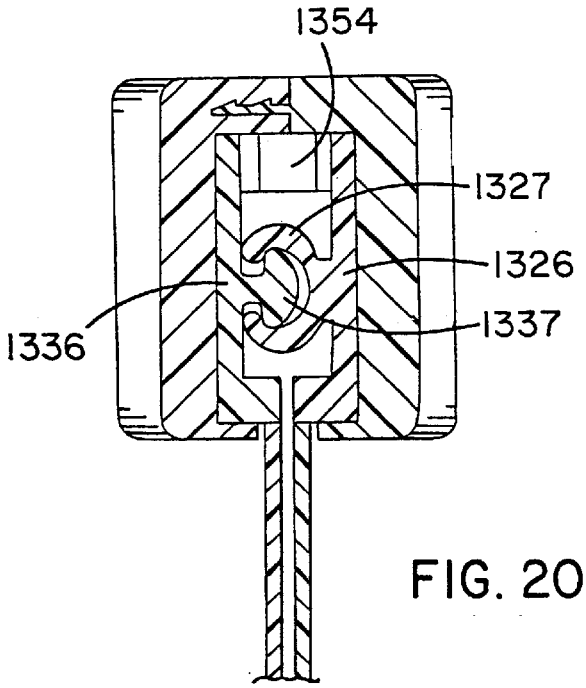
FIG. 20 is a cross-sectional view taken along line 20—20 in FIG. 3, showing a third embodiment of the interlocking fastening strips.
Figure 21:
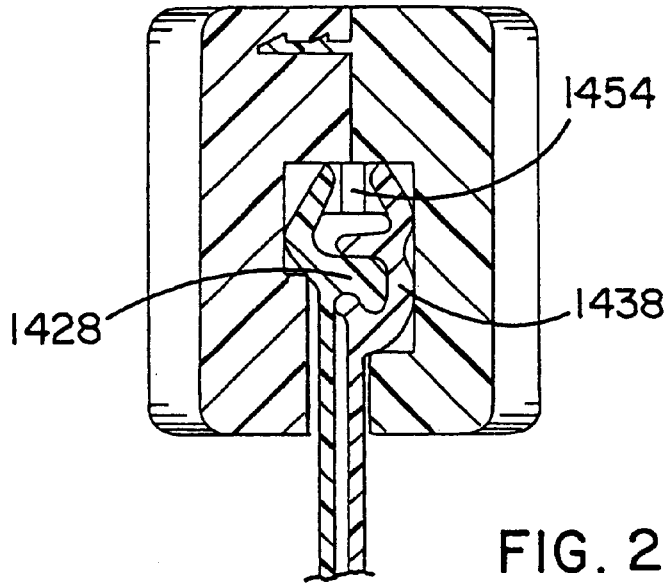
FIG. 21 is a cross-sectional view taken along line 21—21 in FIG. 3, showing a fourth embodiment of the interlocking fastening strips.

As will be readily appreciated by those skilled in the art, the slider member 150 may be provided with a separator finger or other structure which extends downwardly from one or both of the top portions 162 and 172 of the first and second housing segments 160 and 170, as shown, for example, in FIGS. 20 and 21, and into an internal void 155 between the side portions 166 and 176 of the two housing segments 160 and 170. In use, this finger provides for the separation of the interlocking fastening strips when the slider member 150 is moved in the deocclusion direction 152, as disclosed, for example, in U.S. Pat. Nos. 5,007,142, 5,007,143, 5,010,627, 5,020,194, 5,067,208, 5,070,583, 5,088,971, 5,131,121, 5,161,286, 5,189,764, 5,282,932, 5,301,395, 5,426,830, 5,448,808, and 5,442,837.

In accordance with several important aspects of the present invention, the first and second housing segments of the inventive slider member are also provided with an attachment mechanism which facilitates their installation upon and assembly onto the interlocking fastening strips. As will be described in greater detail below, several embodiments of the inventive attachment mechanism are illustrated herein at FIGS. 4–7, 8–11, 12–15, 16, and 17, respectively. In each embodiment, the attachment mechanism permits the first and second housing segments to be selectively moved into a multiplicity of distinct and predetermined assembly positions with respect to each other and the interlocking fastening strips. Due to this novel construction, each embodiment of the attachment mechanism enables the first and second housing segments to be conveniently handled as a single unit prior to and during their installation upon and assembly onto the fastening strips. This novel construction also eliminates loose pieces by permitting partially pre-assembly of the first and second housing segments. Each embodiment of the inventive attachment mechanism will now be discussed in turn.

As best shown in FIGS. 4–7, the first embodiment of the inventive attachment mechanism 200 comprises a pair of spaced-apart locking fingers or appendages 210 projecting from the top portion 162 of the first housing segment 160, and a pair of cooperating slots 250 formed in the top portion 172 of the second housing segment 170. More specifically, the appendages 210 of the attachment mechanism 200 are aligned with each other and project outwardly from the face 163 of the first housing segment 160 to a length 211. The slots 250 of the attachment mechanism 200 are aligned with each other and project inwardly from the face 173 of the second housing segment 170 to a length 251. The appendages 210 of the first housing segment 160 are also aligned with the slots 250 of the second housing segment 170. As a consequence, the slots 250 of the attachment mechanism 200 are positioned to receive the appendages 210 and 220 of the attachment mechanism 200 when the first and second housing segments 160 and 170 are moved together, as shown, for example, in FIGS. 6 and 7. Although other constructions are permissible and would certainly fall within the scope and spirit of the present invention, those skilled in the art will readily appreciate forming the appendages 210 of the attachment mechanism 200 and the first housing segment 160 of the slider member 150 of unitary construction provides many advantages.

In order to provide distinct and predetermined assembly positions for the first and second housing segments 160 and 170, a pair of barbs 212 and 216 are formed along the length 211 of each appendage. The barbs 212, 216 are adapted to engage and selectively interact with a pair of complementary-shaped notches 252 and 256 formed along the length 251 of each slot 250. These barbs 212 and 216 and notches 252 and 256 also permit the first and second housing segments 160 and 170 to be partially pre-assembled which simplifies their handling, eliminates loose pieces, and facilitates their installation upon and assembly onto the interlocking fastening strips 120, 130.

During pre-assembly, the first and second housing segments 160 and 170 are initially moved into an unassembled position, as shown, for example, in FIGS. 4 and 5. In the unassembled position, the first housing segment 160 is spaced-apart from, but substantially aligned with, the second housing segment 170. Next, the two appendages 210 of the attachment mechanism 200 are moved into engagement with the two slots 250 of the attachment mechanism 200 while opposing forces are applied to the first and second housing segments 160 and 170 to move these two housing segments 160 and 170 into a first assembly position, as shown in FIG. 6. In the first assembly position, the first barbs 212 of the two appendages 210 are received by the second or outwardmost notches 256 of the two slots 250 to provide a convenient first snap-fit interface between, and partial pre-assembly of, the first and second housing segments 160 and 170. In addition, the shoulder 165 of the first housing segment 160 is separated from the shoulder 175 of the second housing segment 170 by a first gap 156 while the second barbs 216 of the two appendages 210 are disposed between the opposed faces 163 and 173 of the first and second housing segments 160 and 170. Because this first gap 156 is greater than the width 116 of the interlocking fastening strips 120, 130, the partially pre-assembled first and second housing segments 160 and 170 may be freely installed upon or removed from the interlocking fastening strips without interference therewith. In fact, when the first and second housing segments 160 and 170 are in the first assembly position, this first gap 156 permits the internal void 155 between the side portions 166 and 176 of the first and second housing segments 160 and 170 to conveniently receive the interlocking fastening strips 120, 130 without the shoulders 165 and 175 of the first and second housing segments 160 and 170 obstructively interfering with or otherwise blocking their receipt.

Figure 7:
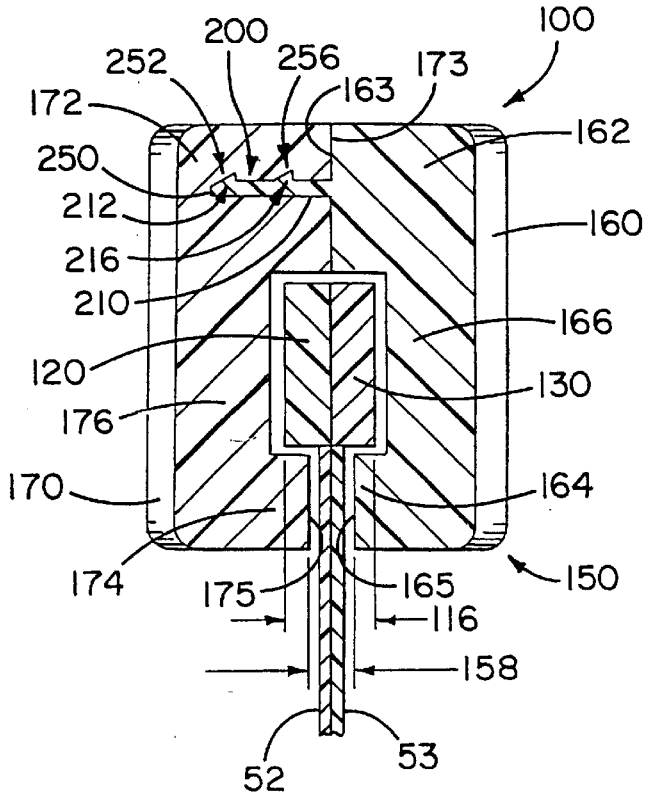
FIG. 7 is a cross-sectional view taken along line 7—7 in FIG. 4, but showing the first and second housing segments of the slider member in a second assembly position upon the interlocking fastening strips.

Once the first and second housing segments 160 and 170 have been partially pre-assembled into the first assembly position and installed upon the interlocking fastening strips 120, 130, as shown in FIG. 6, these two housing segments 160 and 170 may then be moved into a second assembly position, as shown in FIG. 7, by applying opposing forces thereto. In this embodiment, the second assembly position is the final assembly position. In other embodiments, the attachment mechanism may have additional assembly positions before the final assembly position. In the second assembly position, the first and second barbs 212 and 216 of the two appendages 210 are received by the first and second notches 252 and 256 of the two slots 250, respectively, to provide a second snap-fit interface between, and final assembly of, the first and second housing segments 160 and 170. In addition, the shoulder 165 of the first housing segment 160 is separated from the shoulder 175 of the second housing segment 170 by a second gap 158 while the face 163 of the first housing segment 160 abuts the face 173 of the second housing segment 170. Because this second gap 158 is less than the width 116 of the interlocking fastening strips, the completely assembled first and second housing segments 160 and 170 are advantageously retained on and may not be removed from the fastening strips while in the second assembly position.

As best depicted in FIG. 4, the barbs 212 and 216 of the appendages 210 and the notches 252 and 256 of the slots 250 each have a generally right-triangular configuration. In particular, the first and second barbs 212 and 216 of the two appendages 210 each have an inclined surface 213 and 217, respectively, which advances toward the face 163 of the first housing segment 160 in an outwardly sloping manner, and an edge 214 and 218, respectively, which abruptly transitions back toward the longitudinal axes of the appendages 210 in a substantially perpendicular manner. Similarly, the first and second notches 252 and 256 of the two slots 250 each have an inclined surface 253 and 257, respectively, which advances toward the face 173 of the second housing segment 170 in an outwardly sloping manner, and an edge 254 and 258, respectively, which abruptly transitions back toward the longitudinal axes of the slots 250 in a substantially perpendicular manner.

On account of this novel construction, the barbs 212 and 216 of the appendages 210 interact with the notches 252 and 256 of the slots 250 when the first and second housing segments 160 and 170 are moved together to provide suitable snap-fit interfaces therebetween at the first and second assembly positions. This novel construction also substantially prevents removal of the appendages 210 from the slots 250 when the first and second housing segments 160 and 170 are in either the first or second assembly position. By way of example, when the appendages 210 are pushed into the slots 250 of attachment mechanism 200 during assembly, the inclined surfaces 213 of the first barbs 212 cause the slots 250 of the attachment mechanism 200 to expand slightly to facilitate receipt and insertion of the appendages 210. Upon reaching the first assembly position, however, the second notches 256 receive the first barbs 212 in a snap-fit manner which causes the slots 250 to return to their normal size, as shown in FIG. 6. In addition, the edges 214 of the first barbs 212 engage the edges 258 of the second notches 256 to substantially prevent removal of the appendages 210 from the slots 250.

When the appendages 210 are pushed further into the slots 250, the inclined surfaces 213 of the first barbs 212 cause the slots 250 to expand slightly again to facilitate further receipt and insertion of the appendages 210. Upon reaching the second assembly position, however, the first and second notches 252 and 256 receive the first and second barbs 212 and 216 in a snap-fit manner which causes the slots 250 to return to their normal size, as shown in FIG. 7. In addition, the edges 214 and 218 of the first and second barbs 212 and 216 engage the edges 254 and 258 of the first and second notches 256 and 258 to substantially prevent removal of the appendages 210 from the slots 250.

A second embodiment of the inventive attachment mechanism 400 is shown in FIGS. 8–11. In this embodiment, the attachment mechanism 400 comprises three spaced-apart locking fingers or appendages 410, 420, and 430 which project from the top portion 362 of the first housing segment 360 and three cooperating slots 450, 460, and 470 which are formed in the top portion 372 of the second housing segment 370. More specifically, the first and second or two outer appendages 410 and 420 of the attachment mechanism 400 are in alignment with each other and project outwardly from the face 363 of the first housing segment 360 to a length 411. The third or inner appendage 430 of the attachment mechanism 400 is offset from the two outer appendages 416 and 420 as shown in FIG. 8 and projects outwardly from the face 363 of the first housing segment 360 to a length 431. Similarly, the first and second or two outer slots 450 and 460 of the attachment mechanism 400 are in alignment with each other and project inwardly from the face 373 of the second housing segment 370 to a length 451. In addition, the third or inner slot 470 of the attachment mechanism 400 is offset from the two outer slots 450 and 460 and projects inwardly from the face 373 of the second housing segment 370 to a length 471.

As best shown in FIG. 9, the two outer appendages 410 and 420 and the two outer slots 450 and 460 of the attachment mechanism 400 are symmetrically disposed about a transverse line or axis which extends through the centers of the inner appendage 430 and the inner slot 470, such as cross-sectional line 11—11. The three appendages 410, 420, and 430 of the first housing segment 360 are also aligned with the three slots 450, 460, and 470 of the second housing segment 370. In this way, when the first and second housing segments 360 and 370 of the'slider member 350 are moved together, as shown, for example, in FIGS. 10 and 11, the three slots 450, 460, and 470 of the attachment mechanism are positioned to receive the three appendages 410, 420, and 430 of the attachment mechanism. While other constructions are certainly permissible, those skilled in the art will readily appreciate that forming the appendages 410, 420, and 430 of the attachment mechanism 400 and the first housing segment 360 of the slider member 350 of unitary construction provides obvious manufacturing advantages.

In order to provide distinct and predetermined assembly positions for the first and second housing segments 360 and 370, a barb 412, 422, and 432 is formed at the distal end of each appendage 410, 420, and 430 which is adapted to engage and selectively interact with one or more complementary-shaped notches 452, 456, 462, 466, and 472 formed along the length 451 and 471 of each slot 450, 460, and 470. The barbs 412, 422 and notches 456, 466 also facilitate the partial pre-assembly of the first and second housing segments 360 and 370.

Figure 10:
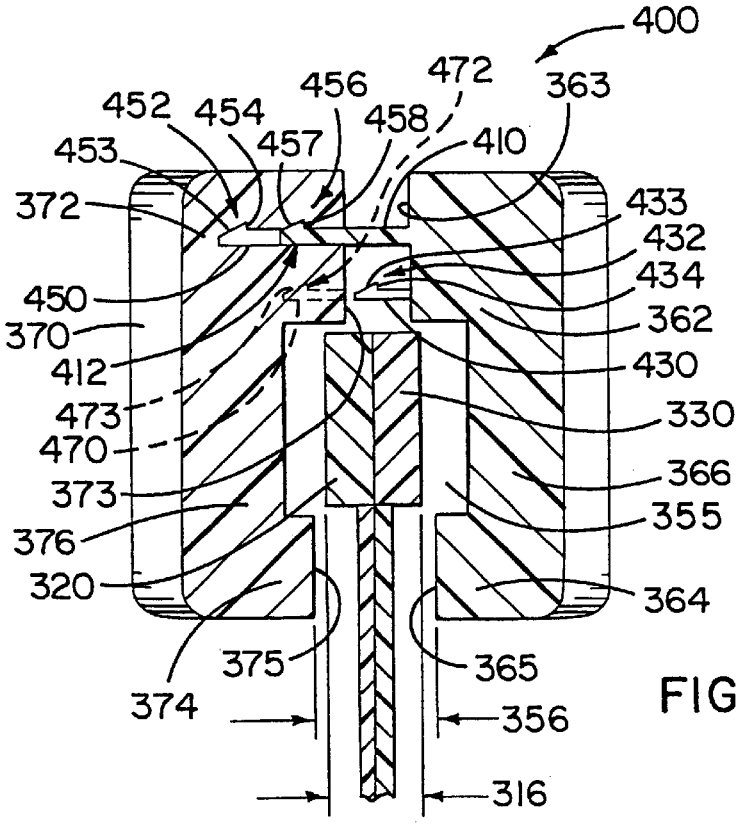
FIG. 10 is a cross-sectional view taken along line 10—10 in FIG. 9, but showing the first and second housing segments of the slider member in a first assembly position upon the interlocking fastening strips.

During such pre-assembly, the first and second housing segments 360 and 370 are initially moved into an unassembled position, as shown in FIGS. 8 and 9, wherein the first housing segment 360 is spaced-apart from, but substantially aligned with, the second housing segment 370. Next, the two outer appendages 410 and 420 of the attachment mechanism 400 are moved into engagement with the two outer slots 450 and 460 of the attachment mechanism 400 while opposing forces are applied to the first and second housing segments 360 and 370 to move these two housing segments into a first assembly position, as shown in FIG. 10. In the first assembly position, the barbs 412 and 422 of the outer appendages 410 and 420 are received by the second or outwardmost notches 456 and 466 of the outer slots 450 and 460 to provide a first snap-fit interface between, and partial pre-assembly of, the first and second housing segments 360 and 370. In addition, the shoulder 365 of the first housing segment 360 is separated from the shoulder 375 of the second housing segment 370 by a first gap 356 while the barb 432 of the inner appendage 430 is disposed between the opposed faces 363 and 373 of the first and second housing segments 360 and 370. Because this first gap 356 is greater than the width 316 of the interlocking fastening strips 320, 330, the partially pre-assembled first and second housing segments 360 and 370 may be freely installed upon the fastening strips. In the first assembly position, the shoulders 365 and 375 of the first and second housing segments 360 and 370 will not obstructively engage or otherwise block the fastening strips from entering the internal void of the slider member 350.

Figure 11:
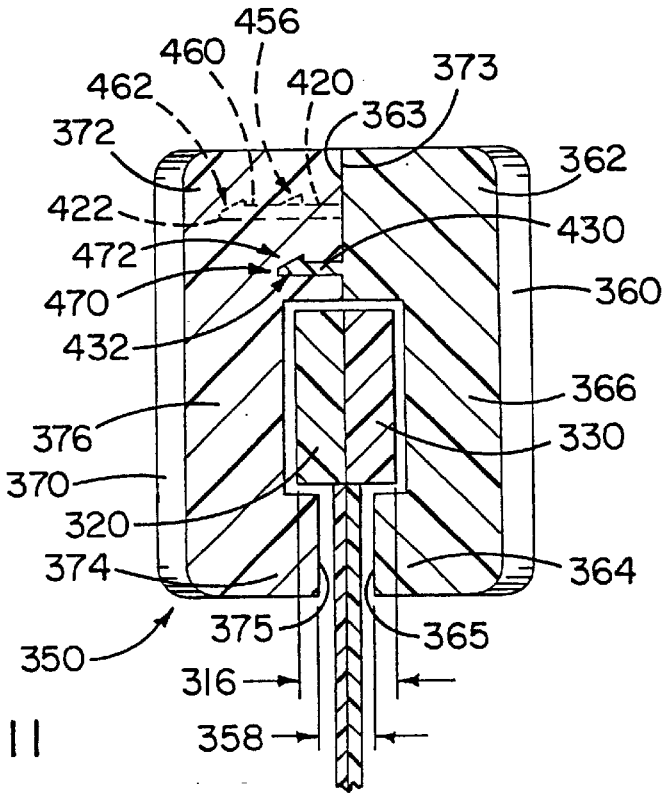
FIG. 11 is a cross-sectional view taken along line 11—11 in FIG. 9, but showing the first and second housing segments of the slider member in a second assembly position upon the interlocking fastening strips.

After the first and second housing segments 360 and 370 have been partially pre-assembled into the first assembly position and installed upon the interlocking fastening strips, as shown in FIG. 10, these two housing segments 360 and 370 may then be moved into a second assembly position, as shown in FIG. 11, by applying opposing forces thereto. In this embodiment, the second assembly position is the final assembly position. In other embodiments, the attachment mechanism may have additional assembly positions before the final assembly position. In the second assembly position, the barbs 412 and 422 of the two outer appendages 410 and 420 are received by the first or inwardmost notches 452 and 462 of the two outer slots 450 and 460 while the barb 432 of the inner appendage 430 is received by the notch 472 of the inner slot 470 to provide a second snap-fit interface between, and final assembly of, the first and second housing segments 360 and 370. In addition, the shoulder 365 of the first housing segment 360 is separated from the shoulder 375 of the second housing segment 370 by a second gap 358 while the face 363 of the first housing segment 360 abuts the face 373 of the second housing segment 370. Because this second gap 358 is less than the width 316 of the interlocking fastening strips 320, 330, the completely assembled first and second housing segments 360 and 370 may not be removed from the interlocking fastening strips while in the second assembly position as shown in FIG. 11.

As in the first embodiment, the barbs 412, 422, and 432 of the three appendages 410, 420, and 430 each have a generally right-triangular configuration with an inclined surface 413, 423, and 433, respectively, and an edge 414, 424, and 434, respectively. Similarly, the first and second notches 452, 456, 462, and 466 of the two outer slots 450 and 460 and the notch 472 of the inner slot 470 each have a generally triangular configuration with a corresponding inclined surface 453, 457, 463, 467, and 473, respectively, and an edge 454, 458, 464, 468, and 474, respectively.

On account of this construction, the barbs 412 and 422 of the two outer appendages 410 and 420 interact with the second or outwardmost notches 456 and 466 of the two outer slots 450 and 460 when the first and second housing segments 360 and 370 are pushed together to provide a first snap-fit interface between the first and second housing segments 360 and 370 at the first assembly position. Likewise, the barbs 412 and 422 of the two outer appendages 410 and 420 interact with the first or inwardmost notches 452 and 462 of the two outer slots 450 and 460 while the barb 432 of the inner appendage 430 interacts with the notch 472 of the inner slot 470 to provide a second snap-fit interface between the first and second housing segments 360 and 370 at the second assembly position.

This construction also restricts removal of the appendages 410, 420, and 430 from the slots 450, 460, and 470 when the first and second housing segments 360 and 370 are in either the first or second assembly positions. In fact, when the appendages 410, 420 and 430 of the attachment mechanism 400 are pushed into the slots 450, 460, and 470 of the attachment mechanism 400 during assembly, the inclined surfaces 413 and 423 of the two outer appendages 410 and 420 cause the two outer slots 450 and 460 to expand slightly to facilitate receipt and insertion of these appendages 410 and 420. Upon reaching the first assembly position, the second notches 456 and 466 of the two outer slots 450 and 460 receive the barbs 412 and 422 of the two outer appendages 410 and 420 in a snap-fit manner which causes the slots 450 and 460 to return to their normal size, as shown in FIG. 10. In addition, the edges 414 and 424 of barbs 412 and 422 engage the edges 458 and 468 of the second notches 456 and 468 to substantially prevent removal of the outer appendages 410 and 420 from the two outer slots 450 and 460.

When the two outer appendages 410 and 420 are pushed further into the two outer slots 450 and 460, the inclined surfaces 413 and 423 of the barbs 412 and 422 cause the two outer slots 450 and 460 to expand slightly again to facilitate further receipt and insertion of the outer appendages 410 and 420. In addition, the inner appendage 430 is received by the inner slot 470 and the barb 432 causes the slot 470 to expand slightly as noted above. Upon reaching the second assembly position, the first notches 452 and 462 of the two outer slots 450 and 460 receive the barbs 412 and 422 of the two outer appendages 410 and 420 in a snap-fit manner which causes the two outer slots 450 and 460 to return to their normal size, as shown in FIG. 11. Also, the notch 472 of the inner slot 470 receives the barb 432 of the inner appendage 430 in a snap-fit manner which causes the inner slot 470 to return to its normal size.

In addition, the edges 414 and 424 of the barbs 412 and 422 of the two outer appendages 410 and 420 engage the edges 454 of the first notches 452 and 462 of the two outer slots 450 and 460. Furthermore, the edge 434 of the barb 432 of the inner appendage 430 engages the edge 474 of the notch 472 of the inner slot 470. These engagements substantially prevent removal of the three appendages 410, 420, and 430 from the three slots 450, 460, and 470.

A third embodiment of the inventive attachment mechanism 600 is shown in FIGS. 12–15. The third embodiment of the attachment mechanism 600 is similar to the second embodiment of the attachment mechanism 400 except that the outer appendages 610, 620 are perpendicular to the inner appendage 630 whereas the outer appendages are parallel to the inner appendage in the second embodiment. Like the second embodiment of the attachment mechanism 400 depicted in FIGS. 8–11, the third embodiment of the attachment mechanism 600 comprises three spaced-apart locking fingers or appendages 610, 620, and 630 which project outwardly from the top portion 562 of the first housing segment 560. In addition, the attachment mechanism 600 includes three cooperating slots 650, 660, and 670 which are formed in the top portion 572 of the second housing segment 570. The other features of the third embodiment are similar to the second embodiment and have similar reference numerals. In addition, the third embodiment operates in a similar manner to the second embodiment.

Figure 16:
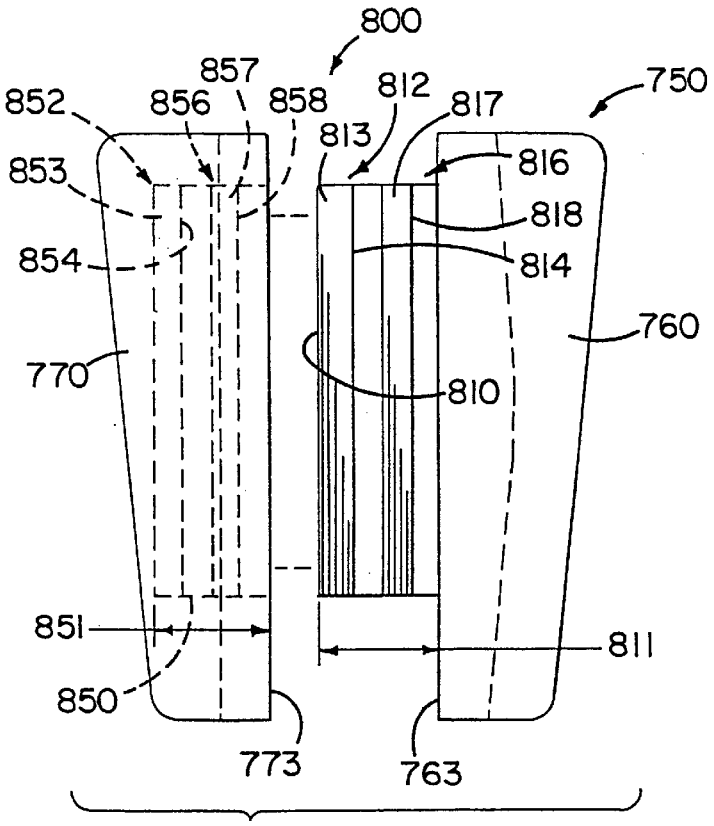
FIG. 16 is a top plan view of another embodiment of the slider member showing the two housing segments of the slider member in an unassembled position and showing a fourth embodiment of the attachment mechanism.

A fourth embodiment of the inventive attachment mechanism 800 is shown in FIG. 16. The fourth embodiment of the attachment mechanism 800 is similar to the first embodiment of the attachment mechanism 200 except that the fourth embodiment has one wide appendage 810 whereas the second embodiment has two narrower appendages. In this embodiment, the attachment mechanism 800 comprises a single locking finger or appendage 810 projecting from the top portion 762 of the first housing segment 760 and a single cooperating slot 850 formed in the top portion 772 of the second housing segment 770. The other features of the fourth embodiment are similar to the first embodiment and have similar reference numerals. In addition, the fourth embodiment operates in a similar manner to the first embodiment.

Figure 17:
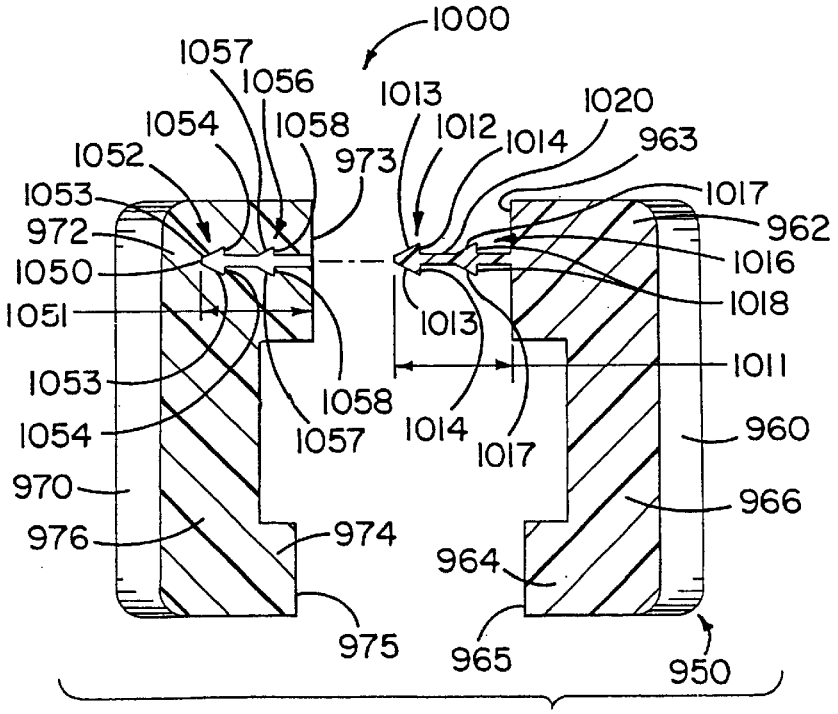
FIG. 17 is a cross-sectional view of another embodiment showing the first and second housing segments of the slider member in an unassembled position and showing a fifth embodiment of the attachment mechanism.

A fifth embodiment of the inventive attachment mechanism 1000 is shown in FIG. 17. The appendage(s) may include barb(s) on other surfaces of the appendage. For example, if the appendage is rectangular in cross-section, then the barbs may extend upward, downward, left and/or right. If the appendage is circular in cross-section, then the barbs may be annular around the perimeter of the appendage. In this embodiment, the attachment mechanism 1000 comprises one or more locking fingers or appendages 1010 which project from the top portion 962 of the first housing segment 960 and one or more cooperating slots 1050 which are formed in the top portion 972 of the second housing segment 970. More specifically, the appendage or appendages 1010 of the attachment mechanism 1000 project outwardly from the face 963 of the first housing segment 960 to a length 1011. The slot or slots 1050 of the attachment mechanism 1000 project inwardly from the face 973 of the second housing segment 970 to a length 1051. As in prior embodiments, the appendages 1010 of the first housing segment 960 are also aligned with the slots 1050 of the second housing segment 970. In this way, the slots 1050 of the attachment mechanism 1000 are positioned to receive the appendages 1010 of the attachment mechanism 1000 when the first and second housing segments 960 and 970 are moved together.

In addition, the appendages 1010 of the attachment mechanism 1000 have a pair of barbs 1012 and 1016 formed along their length 1011 which are adapted to engage and selectively interact with a pair of complementary-shaped notches 1052 and 1056 formed along the length 1051 of the slots 1050 to provide distinct and predetermined assembly positions for the first and second housing segments 960 and 970. While other constructions are certainly permissible, those skilled in the art will readily appreciate that many manufacturing advantages are provided by forming the appendages 1010 of the attachment mechanism 1000 and the first housing segment 960 of the slider member 950 of unitary construction.

Figure 14:
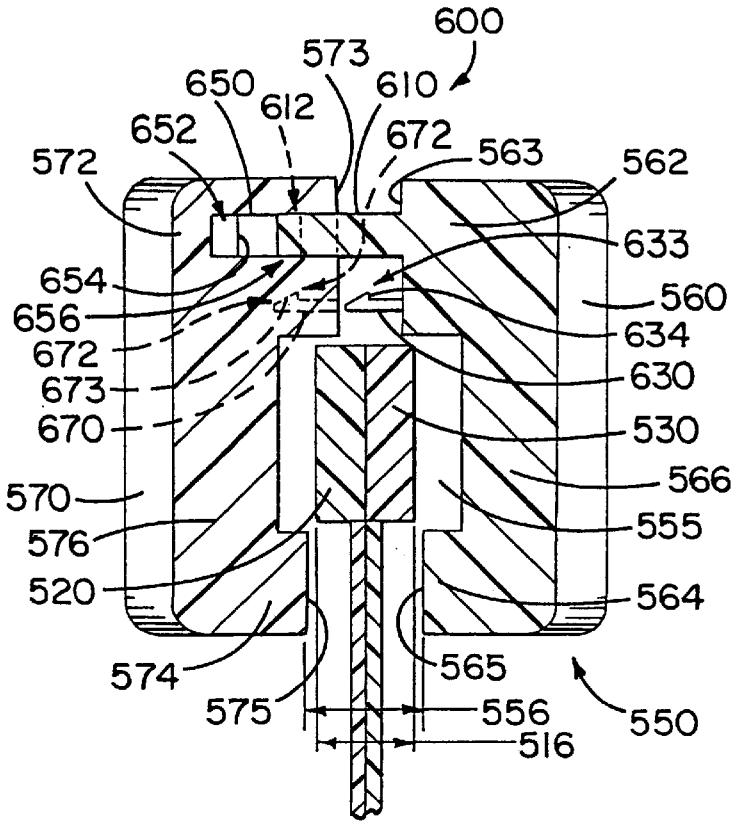
FIG. 14 is a cross-sectional view taken along line 14—14 in FIG. 13, but showing the first and second housing segments of the slider member in a first assembly position upon the interlocking fastening strips.
Figure 15:
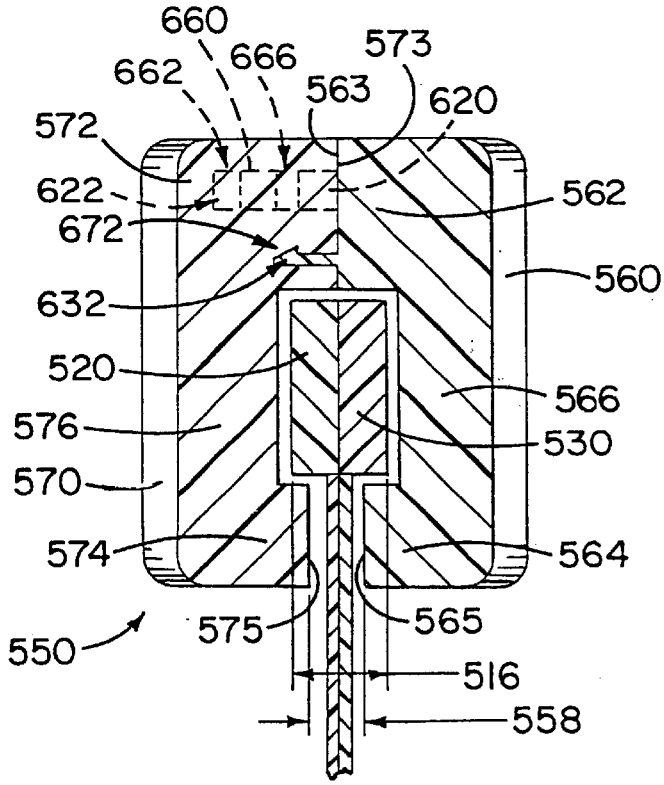
FIG. 15 is a cross-sectional view taken along line 15—15 in FIG. 13, but showing the first and second housing segments of the slider member in a second assembly position upon the interlocking fastening strips.

Like the other embodiments of the attachment mechanism, the fifth embodiment of the attachment mechanism 1000 permits the first and second housing segments 960 and 970 to be moved into a partially pre-assembled or first assembly position, analogous to FIGS. 6, 10, and 14, and a completely assembled or second assembly position, analogous to FIGS. 7, 11, and 15, simply by aligning the first and second housing segments 960 and 970 and applying opposing forces thereto. In the first assembly position, the first barb 1012 of the appendages 1010 is received by the second notches 1056 of the slots 1050 to provide a first snap-fit interface between, and partial pre-assembly of, the first and second housing segments 960 and 970. In addition, the shoulder 965 of the first housing segment 960 is separated from the shoulder 975 of the second housing segment 970 by a first gap which is greater than the width of the interlocking fastening strips. As such, the partially pre-assembled first and second housing segments 960 and 970 may be freely installed upon the fastening strips. In the first assembled position, the shoulders 965 and 975 of the first and second housing segments 960 and 970 will not obstructively engage or otherwise block the fastening strips from entering the internal void of the slider member 950.

In the second assembly position, conversely, the first and second barbs 1012 and 1016 of the appendages 1010 are received by the first and second notches 1052 and 1056 of the slots 1050 to provide a second snap-fit interface between, and final assembly of, the first and second housing segments 960 and 970. In addition, the shoulder 965 of the first housing segment 960 is separated from the shoulder 975 of the second housing segment 970 by a second gap while the face 963 of the first housing segment 960 abuts the face 973 of the second housing segment 970. Because this second gap is less than the width of the interlocking fastening strips, the completely assembled first and second housing segments 960 and 970 are prevented from being removed from the interlocking fastening strips while in the second assembly position.

In the fifth embodiment of the attachment mechanism 1000, the two barbs 1012 and 1016 of the appendages 1010 and the two notches 1052 and 1056 of the slots 1050 each have an isosceles-triangular or arrowhead-shaped configuration which is symmetrical about the longitudinal axes of the appendage 1010 and the slot 1050, respectively. More specifically, the first barb 1012 of the appendages 1010 includes a pair of opposed inclined surfaces 1013 and a pair of opposed edges 1014 while the second barb 1016 of the appendages 1010 includes a pair of opposed inclined surfaces 1017 and a pair of opposed edges 1018. Likewise, the first notch 1052 of the slots 1050 includes a pair of opposed inclined surfaces 1053 and a pair of opposed edges 1054 while the second notch 1056 of the slots 1050 includes a pair of opposed inclined surface 1057 and a pair of opposed edges 1058.

As described more fully above in connection with the other embodiments, the two barbs 1012 and 1016 of the appendages 1010 interact with the similarly-shaped notches 1052 and 1056 of the slots 1050 when the first and second housing segments 960 and 970 are moved together to provide suitable snap-fit interfaces therebetween at the first and second assembly positions. In addition, engagement between the opposed edges 1014 and 1018 of the barbs 1012 and 1016 and the opposed edges 1054 and 1058 of the notches 1052 and 1056 substantially prevents removal of the appendages 1010 from the slots 1050 when the first and second housing segments 960 and 970 are in the first and second assembly positions. Because the opposed edges 1014 and 1018 of the barbs 1012 and 1016 and the opposed edges 1054 and 1058 of the notches 1052 and 1056 provide engagement on both sides of the appendages 1010 and slots 1050, the fifth embodiment of the attachment mechanism 1000 provides an added degree of retention which makes removing the appendages 1010 from the slots 1050 a more difficult task.

While several embodiments of the inventive attachment mechanism have been specifically described and illustrated herein, it will be appreciated by those skilled in the art that these particular embodiments have been provided for illustrative purposes only and do not represent an exhaustive list of each and every attachment mechanism covered by the present invention. Indeed, other types, kinds, versions, and forms of the attachment mechanism may alternatively be employed without departing from the scope or spirit of the present invention.

Figure 18:
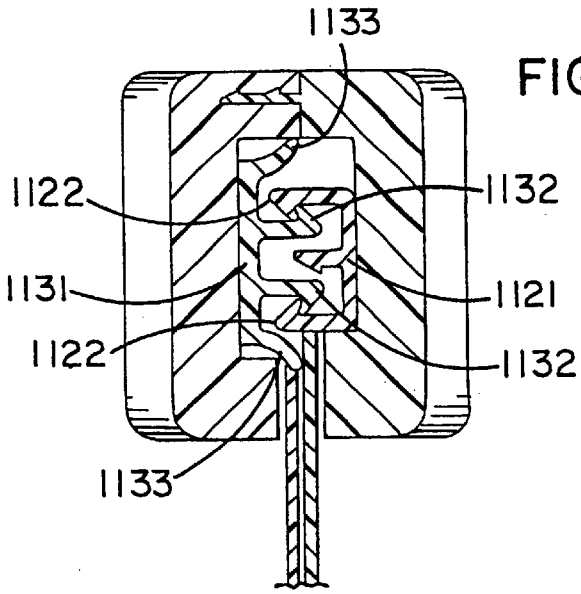
FIG. 18 is a cross-sectional view taken along line 18—18 in FIG. 3, and showing a first embodiment of the interlocking fastening strips.

As mentioned briefly above, the interlocking fastening strips of the present invention may also be of virtually any type, kind, version, or form. By way of example, the interlocking fastening strips may comprise U-channel closure strips, a shown in FIG. 18. U-channel closure strips include a female element 1121 which interlockingly receives a male element 1131. As shown in FIG. 18, the male element 1131 includes a pair of inner hook portions 1132 and a pair of outer wings 1133 while the female element 1121 includes a pair of hook portions 1122 which are adapted to interlockingly engage the hook portions 1132 of the male element 1131.

Figure 19:
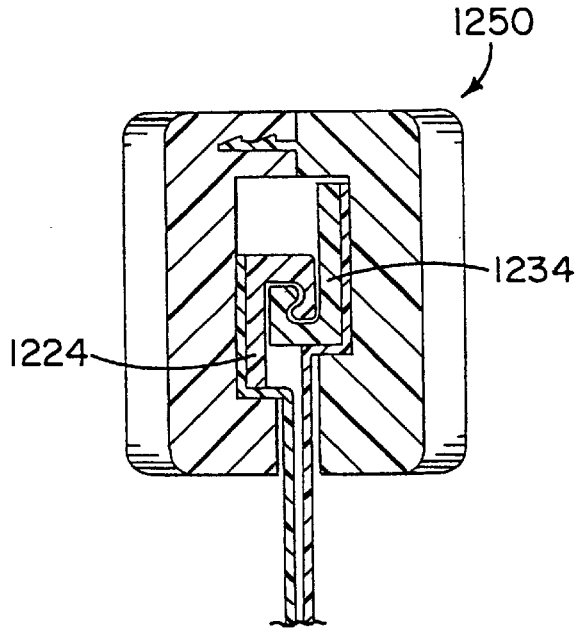
FIG. 19 is a cross-sectional view taken along line 19—19 in FIG. 3, showing a second embodiment of the interlocking fastening strips.

The interlocking fastening strips may comprise shear action or Z-axis closure strips, as shown in FIG. 19. Shear action closure strips include a first web 1224 and a complementary second web 1234 which occlude upon moving the slider member 1250 in the occlusion direction.

In addition, the interlocking fastening strips may comprise arrowhead-type closure strips, as shown in FIG. 20. As described more fully in U.S. Pat. Nos. 3,198,228 (which reissued as Re. 28,969), 4,736,496, and 5,363,540, arrowhead-type closure strips include an outer female web 1326 with a C-shaped engagement portion 1327 and an inner male web 1336 with an arrowhead-shaped engagement portion 1337. In use, the inner male web 1336 and the outer female web 1326 are selectively coupled and decoupled by moving the slider member 350 in the appropriate direction. This coupling/decoupling action is facilitated by a separator finger 1354 (only a portion of which is shown) which projects downwardly between the inner male web 1336 and the outer female web 1326.

As shown in FIG. 21, the interlocking fastening strips may comprise rolling action closure strips, as shown, for example, in FIG. 21. As described in greater detail in U.S. Pat. No. 5,007,143, rolling action closure strips include elements 1438 and 1428. In another embodiment, a separator finger 1454 (only a portion of which is shown) may be used to deocclude the fastening strips.

Figure 22:
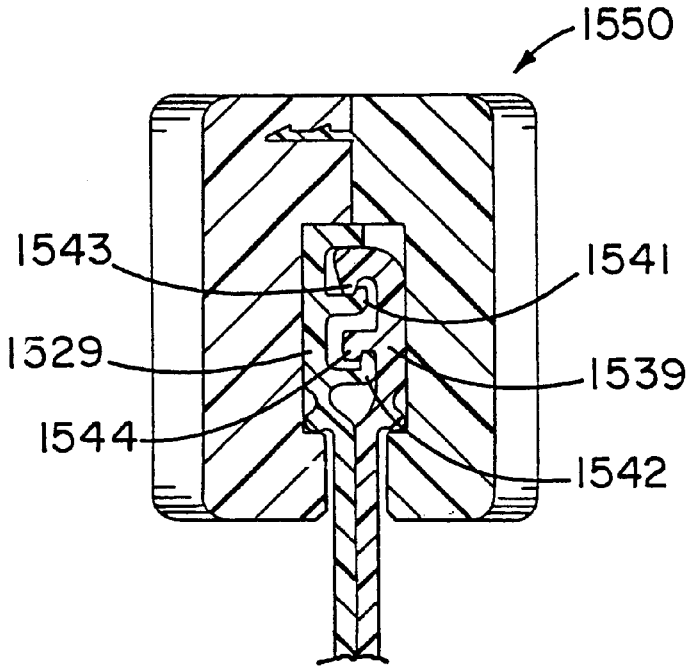
FIG. 22 is a cross-sectional view taken along line 22—22 in FIG. 3, showing a fifth embodiment of the interlocking fastening strips.

The interlocking fastening strips may comprise profile closure strips, as shown in FIG. 22. As described more fully in U.S. Pat. No. 5,664,299, profile closure strips include a first profile 1529 having uppermost and bottommost closure elements 1541 and 1542, respectively, and a second profile 1539 having corresponding uppermost and bottommost closure elements 1543 and 1544, respectively. In use, the uppermost and bottommost closure elements 1541, 1542, 1543, and 1544 of the first and second profiles 1529 and 1539 are selectively coupled and decoupled by moving the slider member 1550 in the appropriate direction.

It will be readily appreciated by those skilled in the art that each embodiment of the inventive attachment mechanism may be employed with these and other types of fastening strips without departing from the scope or spirit of the present invention.

The slider can be colored, opaque or clear. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

The interlocking fastening strips may be manufactured by extrusion through a die. In addition, the fastening strips may be manufactured to have approximately uniform cross-sections. This not only simplifies the manufacturing of a closure device, but also contributes to the physical flexibility of the closure device, which may be a desirable property.

Generally, the interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips. In most instances, the fastening strips are preferably made from low density polyethylene. The selection of the appropriate thermoplastic material, however, is related to the particular design of the fastening strips, the Young's Modulus of the thermoplastic material, and the desired elasticity and flexibility of the strips.

When the interlocking fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. In most instances, the bag is preferably made from a mixture of high pressure, low density polyethylene and linear, low density polyethylene.

The interlocking fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the closure device or expected additional manufacturing operations.

Generally, the closure device can be manufactured in a variety of forms to suit the intended use. The closure device may be integrally formed on the opposing side walls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

In summary, the present invention provides a multi-piece slider member for use with a closure device having interlocking fastening strips disposed along opposing side walls of a storage container, such as a conventional plastic bag. The slider member is slidably disposed upon the interlocking fastening strips to facilitate the occlusion and deocclusion of the fastening strips when moved towards first and second ends thereof. The inventive slider member comprises a first housing segment, a second housing segment, and an attachment mechanism for use in assembling the first and second housing segments together onto the interlocking fastening strips.

The attachment mechanism includes at least one appendage projecting from the first housing segment and at least one cooperating slot formed in the second housing segment. The appendage has at least one barb formed along its length and the slot has at least one notch formed along its length. When the first and second housing segments are monad together during assembly, the slot of the attachment mechanism receives the appendage of the attachment mechanism while the barb of the appendage interacts with the notch of the slot to provide at least one assembly position for the first and second housing segments.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. Indeed, the following claims are intended to cover all modifications and variations that fall within the scope and spirit of the present invention. In addition, all references and co-pending applications cited herein are hereby incorporated by reference in their entireties.

What is claimed is:

1. A closure device comprising:

interlocking fastening strips; and a slider member slidably disposed on the interlocking fastening strips, the slider member facilitating the occlusion of said fastening strips when moved towards a first end thereof and facilitating the deocclusion of said fastening strips when moved towards a second end thereof, the slider member having a first housing segment, a second housing segment, and an attachment mechanism for use in assembling the first and second housing segments together onto the interlocking fastening strips, the attachment mechanism comprising a first appendage projecting from the first housing segment and a first slot formed in the second housing segment, said first appendage having a first barb formed along its length and said first slot having a first notch formed along its length, said first slot of the attachment mechanism receiving said first appendage of the attachment mechanism when the first and second housing segments are moved together while said first barb interacts with said first notch to provide a first assembly position for the first and second housing segments, wherein said first appendage includes a second barb and said first slot includes a second notch.

2. The closure device set forth in claim 1, wherein the first and second housing segments of the slider member each include a top portion, a side portion, and a bottom portion, the top portions of the first and second housing segments each having an opposing face and the bottom portions of the first and second housing segments each having an opposing shoulder.

3. The closure device set forth in claim 2, wherein said first appendage of the attachment mechanism projects outwardly from the face of the first housing segment and said first slot of the attachment mechanism projects inwardly from the face of the second housing segment.

4. The closure device set forth in claim 1, wherein said first barb of said first appendage interacts with said first notch of said first slot to provide a first snap-fit interface between the first and second housing segments at said first assembly position.

5. The closure device set forth in claim 1, wherein the interlocking fastening strips comprise profile closure elements.

6. The closure device set forth in claim 1, wherein the first and second barbs interact with the first and second notches when the first and second housing segments are moved together to define distinct first and second assembly positions.

7. The closure device set forth in claim 6, wherein the first and second housing segments of the slider member each include a top portion, a side portion, and a bottom portion, the top portions of the first and second housing segments each having an opposing face and the bottom portions of the first and second housing segments each having an opposing shoulder.

8. The closure device set forth in claim 7, wherein the shoulders of the bottom portions of the first and second housing segments are separated by a first gap when the first and second housing segments are in the first assembly position, said fastening strips having a width, the first gap being greater than the width of the interlocking fastening strips.

9. The closure device set forth in claim 7, wherein the shoulders of the bottom portions of the first and second housing segments are separated by a second gap when the first and second housing segments are in the second assembly position, said fastening strips having a width, the second gap being less than the width of the interlocking fastening strips.

10. The closure device set forth in claim 7, wherein the face of the top portion of the first housing segment abuts the face of the top portion of the second housing segment when the first and second housing segments are in the second assembly position.

11. The closure device set forth in claim 1, wherein the first barb includes an inclined first surface and a first edge and the first notch includes an inclined second surface and a second edge.

12. The closure device set forth in claim 11, wherein the first edge of the barb engages the second edge of the notch to substantially prevent removal of the appendage from the slot when the first and second housing segments are in the first assembly position.

13. The closure device set forth in claim 1, further comprising a second appendage and a second slot.

14. The closure device set forth in claim 1, further comprising a second appendage and a third appendage and a second slot and a third slot.

15. The closure device set forth in claim 14, wherein at least one of the three appendages has a shorter length than the other appendages.

16. The closure device as in claim 14 wherein the first appendage, the second appendage and the third appendage are parallel.

17. The closure device as in claim 16 wherein the first appendage is in a first plane and the third appendage is in a second plane.

18. The closure device as in claim 14 wherein the first appendage is in a first plane and the third appendage is in a second plane.

19. The closure device as in claim 18 wherein the first plane is perpendicular to the second plane.

20. The closure device set forth in claim 14, wherein said second appendage includes a second barb and said second slot includes a second notch.

21. The closure device set forth in claim 20, wherein the first and second barbs interact with the first and second notches when the first and second housing segments are moved together to define distinct first and second assembly positions.

22. The closure device set forth in claim 21, wherein the first and second housing segments of the slider member each include a top portion, a side portion, and a bottom portion, the top portions of the first and second housing segments each having an opposing face and the bottom portions of the first and second housing segments each having an opposing shoulder.

23. The closure device set forth in claim 22, wherein the shoulders of the bottom portions of the first and second housing segments are separated by a first gap when the first and second housing segments are in the first assembly position, said fastening strips having a width, the first gap being greater than the width of the interlocking fastening strips.

24. The closure device set forth in claim 22, wherein the shoulders of the bottom portions of the first and second housing segments are separated by a second gap when the first and second housing segments are in the second assembly position, said fastening strips having a width, the second gap being less than the width of the interlocking fastening strips.

25. The closure device set forth in claim 22, wherein the face of the top portion of the first housing segment abuts the face of the top portion of the second housing segment when the first and second housing segments are in the second assembly position.

26. The closure device set forth in claim 20, wherein the first and second barbs include an inclined surface and an edge and the first and second notches include an inclined surface and an edge.

27. The closure device set forth in claim 26, wherein the edges of the barbs engage the edges of notches to substantially prevent removal of the appendages from the slots when the first and second housing segments are in the first and second assembly positions.

28. The closure device set forth in claim 1, wherein said first barb of said first appendage and said first notch of said first slot each have a generally triangular configuration.

29. The closure device set forth in claim 1, wherein the first housing segment and said first appendage of the attachment mechanism are formed of unitary construction.

30. The closure device set forth in claim 1, wherein the interlocking fastening strips comprise U-channel type closure elements.

31. The closure device set forth in claim 1, wherein the interlocking fastening strips comprise shear action closure elements.

32. The closure device set forth in claim 1, wherein the interlocking fastening strips comprise arrowhead-type closure elements.

33. The closure device set forth in claim 1, wherein the interlocking fastening strips comprise rolling action closure elements.

34. A container comprising:

first and second side walls including a first fastening strip and a second fastening strip respectively, said first and second fastening strips arranged to be interlocked over a predetermined length; and a slider member slidably disposed on the first and second fastening strips for facilitating the occlusion of said fastening strips when moved towards a first end thereof and for facilitating the deocclusion of said fastening strips when moved towards a second end thereof, the slider member including a first housing segment, a second housing segment, and an attachment mechanism for use in assembling the first and second housing segments together onto the interlocking fastening strips, the attachment mechanism comprising a first appendage projecting from the first housing segment and a first slot formed in the second housing segment, said first appendage having a first barb formed along its length and said first slot having a first notch formed along its length, said first slot of the attachment mechanism receiving said first appendage of the attachment mechanism when the first and second housing segments are moved together while said first barb interacts with said first notch to provide a first assembly position for the first and second housing segments, wherein said first appendage includes a second barb and said first slot includes a second notch.

35. The container set forth in claim 34, wherein the first and second housing segments of the slider member each include a top portion, a side portion, and a bottom portion, the top portions of the first and second housing segments each having an opposing face and the bottom portions of the first and second housing segments each having an opposing shoulder.

36. The container set forth in claim 35, wherein said first appendage of the attachment mechanism projects outwardly from the face of the first housing segment and said first slot of the attachment mechanism projects inwardly from the face of the second housing segment.

37. The container set forth in claim 34, wherein said first barb of said first appendage interacts with said first notch of said first slot to provide a first snap-fit interface between the first and second housing segments at said first assembly position.

38. The container set forth in claim 34, wherein the first and second barbs interact with the first and second notches when the first and second housing segments are moved together to define distinct first and second assembly positions.

39. The container set forth in claim 38, wherein the first and second housing segments of the slider member each include a top portion, a side portion, and a bottom portion, the top portions of the first and second housing segments each having an opposing face and the bottom portions of the first and second housing segments each having an opposing shoulder.

40. The container set forth in claim 39, wherein the shoulders of the bottom portions of the first and second housing segments are separated by a first gap when the first and second housing segments are in the first assembly position, said fastening strips having a width, the first gap being greater than the width of the interlocking fastening strips.

41. The container set forth in claim 39, wherein the shoulders of the bottom portions of the first and second housing segments are separated by a second gap when the first and second housing segments are in the second assembly position, said fastening strips having a width, the second gap being less than the width of the interlocking fastening strips.

42. The container set forth in claim 39, wherein the face of the top portion of the first housing segment abuts the face of the top portion of the second housing segment when the first and second housing segments are in the second assembly position.

43. The container set forth in claim 34, wherein the first barb includes an inclined first surface and a first edge and the first notch includes an inclined second surface and a second edge.

44. The container set forth in claim 43, wherein the first edge of the barb engages the second edge of the notch to substantially prevent removal of the appendage from the slot when the first and second housing segments are in the first assembly position.

45. A slider member adapted to facilitate the occlusion and deocclusion of interlocking fastening strips, the slider member comprising:

a first housing segment;

a second housing segment; and an attachment mechanism for use in assembling the first and second housing segments, the attachment mechanism comprising a first appendage projecting from the first housing segment and a first slot formed in the second housing segment, said first appendage having a first barb formed along its length and said first slot having a first notch formed along its length, said first slot of the attachment mechanism receiving said first appendage of the attachment mechanism when the first and second housing segments are moved together while said first barb of the appendage interacts with said first notch of the slot to provide a first assembly position for the first and second housing segments, wherein said first appendage includes a second barb and said first slot includes a second notch.

46. The slider set forth in claim 45, wherein the first and second housing segments of the slider member each include a top portion, a side portion, and a bottom portion, the top portions of the first and second housing segments each having an opposing face and the bottom portions of the first and second housing segments each having an opposing shoulder.

47. The slider set forth in claim 46, wherein said first appendage of the attachment mechanism projects outwardly from the face of the first housing segment and said first slot of the attachment mechanism projects inwardly from the face of the second housing segment.

48. The slider set forth in claim 45, wherein said first barb of said first appendage interacts with said first notch of said first slot to provide a first snap-fit interface between the first and second housing segments at said first assembly position.

49. The slider set forth in claim 45, wherein the first and second barbs interact with the first and second notches when the first and second housing segments are moved together to define distinct first and second assembly positions.

50. The slider set forth in claim 49, wherein the first and second housing segments of the slider member each include a top portion, a side portion, and a bottom portion, the top portions of the first and second housing segments each having an opposing face and the bottom portions of the first and second housing segments each having an opposing shoulder.

51. The slider set forth in claim 50, wherein the shoulders of the bottom portions of the first and second housing segments are separated by a first gap when the first and second housing segments are in the first assembly position, said fastening strips having a width, the first gap being greater than the width of the interlocking fastening strips.

52. The slider set forth in claim 50, wherein the shoulders of the bottom portions of the first and second housing segments are separated by a second gap when the first and second housing segments are in the second assembly position, said fastening strips having a width, the second gap being less than the width of the interlocking fastening strips.

53. The slider set forth in claim 50, wherein the face of the top portion of the first housing segment abuts the face of the top portion of the second housing segment when the first and second housing segments are in the second assembly position.

54. The slider set forth in claim 45, wherein the first barb includes an inclined first surface and a first edge and the first notch includes an inclined second surface and a second edge.

55. The slider set forth in claim 54, wherein the first edge of the barb engages the second edge of the notch to substantially prevent removal of the appendage from the slot when the first and second housing segments are in the first assembly position.

56. A method for manufacturing a closure device comprising the steps of:

providing interlocking fastening strips;

providing a slider member having a first housing segment, a second housing segment, and an attachment mechanism for use in assembling the first and second housing segments together onto the interlocking fastening strips, the attachment mechanism comprising a first appendage projecting from the first housing segment and a first slot formed in the second housing segment, said first appendage having a first barb formed along its length and said first slot having a first notch formed along its length, wherein said first appendage includes a second barb and said first slot includes a second notch, moving the first housing segment and the second housing segment together, said first slot of the attachment mechanism receiving said first appendage of the attachment mechanism when the first and second housing segments are moved together while said first barb interacts with said first notch to provide a first assembly position for the first and second housing segments, the assembled slider member slidably disposed on the interlocking fastening strips, the assembled slider member facilitating the occlusion of said fastening strips when moved towards a first end thereof and facilitating the deocclusion of said fastening strips when moved towards a second end thereof.

57. The method set forth in claim 56, wherein the first and second housing segments of the slider member each include a top portion, a side portion, and a bottom portion, the top portions of the first and second housing segments each having an opposing face and the bottom portions of the first and second housing segments each having an opposing shoulder.

58. The method set forth in claim 57, wherein said first appendage of the attachment mechanism projects outwardly from the face of the first housing segment and said first slot of the attachment mechanism projects inwardly from the face of the second housing segment.

59. The method set forth in claim 56, wherein said first barb of said first appendage interacts with said first notch of said first slot to provide a first snap-fit interface between the first and second housing segments at said first assembly position.

60. The method set forth in claim 56, wherein the first and second barbs interact with the first and second notches when the first and second housing segments are moved together to define distinct first and second assembly positions.

61. The method set forth in claim 60, wherein the first and second housing segments of the slider member each include a top portion, a side portion, and a bottom portion, the top portions of the first and second housing segments each having an opposing face and the bottom portions of the first and second housing segments each having an opposing shoulder.

62. The method set forth in claim 61, wherein the shoulders of the bottom portions of the first and second housing segments are separated by a first gap when the first and second housing segments are in the first assembly position, said fastening strips having a width, the first gap being greater than the width of the interlocking fastening strips.

63. The method set forth in claim 61, wherein the shoulders of the bottom portions of the first and second housing segments are separated by a second gap when the first and second housing segments are in the second assembly position, said fastening strips having a width, the second gap being less than the width of the interlocking fastening strips.

64. The method set forth in claim 61, wherein the face of the top portion of the first housing segment abuts the face of the top portion of the second housing segment when the first and second housing segments are in the second assembly position.

65. The method set forth in claim 56, wherein the first barb includes an inclined first surface and a first edge and the first notch includes an inclined second surface and a second edge.

66. The method set forth in claim 65, wherein the first edge of the barb engages the second edge of the notch to substantially prevent removal of the appendage from the slot when the first and second housing segments are in the first assembly position.

67. A closure device comprising:

interlocking fastening strips; and a slider member slidably disposed on the interlocking fastening strips, the slider member facilitating the occlusion of said fastening strips when moved towards a first end thereof and facilitating the deocclusion of said fastening strips when moved towards a second end thereof, the slider member having a first housing segment, a second housing segment, and an attachment mechanism for use in assembling the first and second housing segments together onto the interlocking fastening strips, the attachment mechanism comprising a first appendage projecting from the first housing segment and a first slot formed in the second housing segment, said first appendage having a first barb formed along its length and said first slot having a first notch formed along its length, said first slot of the attachment mechanism receiving said first appendage of the attachment mechanism when the first and second housing segments are moved together while said first barb interacts with said first notch to provide a first assembly position for the first and second housing segments, said attachment mechanism comprising a second appendage and a second slot, wherein each appendage includes a second barb and each slot includes a second notch.

68. The closure device set forth in claim 67, wherein the first and second barbs interact with the first and second notches when the first and second housing segments are moved together to define distinct first and second assembly positions.

69. The closure device set forth in claim 68, wherein the first and second housing segments of the slider member each include a top portion, a side portion, and a bottom portion, the top portions of the first and second housing segments each having an opposing face and the bottom portions of the first and second housing segments each having an opposing shoulder.

70. The closure device set forth in claim 69, wherein the shoulders of the bottom portions of the first and second housing segments are separated by a first gap when the first and second housing segments are in the first assembly position, said fastening strips having a width, the first gap being greater than the width of the interlocking fastening strips.

71. The closure device set forth in claim 69, wherein the shoulders of the bottom portions of the first and second housing segments are separated by a second gap when the first and second housing segments are in the second assembly position, said fastening strips having a width, the second gap being less than the width of the interlocking fastening strips.

72. The closure device set forth in claim 69, wherein the face of the top portion of the first housing segment abuts the face of the top portion of the second housing segment when the first and second housing segments are in the second assembly position.

73. The closure device set forth in claim 67, wherein the first barb includes an inclined first surface and a first edge and the first notch includes an inclined second surface and a second edge.

74. The closure device set forth in claim 73, wherein the first edge of the barb engages the second edge of the notch to substantially prevent removal of the appendage from the slot when the first and second housing segments are in the first assembly position.

75. A closure device comprising:

interlocking fastening strips; and a slider member slidably disposed on the interlocking fastening strips, the slider member facilitating the occlusion of said fastening strips when moved towards a first end thereof and facilitating the deocclusion of said fastening strips when moved towards a second end thereof, the slider member having a first housing segment, a second housing segment, and an attachment mechanism for use in assembling the first and second housing segments together onto the interlocking fastening strips, the attachment mechanism comprising a first appendage projecting from the first housing segment and a first slot formed in the second housing segment, said first appendage having a first barb formed along its length and said first slot having a first notch formed along its length, said first slot of the attachment mechanism receiving said first appendage of the attachment mechanism when the first and second housing segments are moved together while said first barb interacts with said first notch to provide a first assembly position for the first and second housing segments, wherein the first appendage includes a second barb along its length and the first slot includes a second notch along its length.

76. The closure device set forth in claim 75, wherein the first and second barbs of the first appendage interact with the first and second notches of the first slot when the first and second housing segments are moved together to define distinct first and second assembly positions.

77. The closure device set forth in claim 76, wherein the first and second housing segments of the slider member each include a top portion, a side portion, and a bottom portion, the top portions of the first and second housing segments each having an opposing face and the bottom portions of the first and second housing segments each having an opposing shoulder.

78. The closure device set forth in claim 77, wherein the shoulders of the bottom portions of the first and second housing segments are separated by a first gap when the first and second housing segments are in the first assembly position, said fastenings strips having a width, the first gap being greater than the width of the interlocking fastening strips.

79. The closure device set forth in claim 77, wherein the shoulders of the bottom portions of the first and second housing segments are separated by a second gap when the first and second housing segments are in the second assembly position, said fastening strips having a width, the second gap being less than the width of the interlocking fastening strips.

80. The closure device set forth in claim 77, wherein the face of the top portion of the first housing segment abuts the face of the top portion of the second housing segment when the first and second housing segments are in the second assembly position.

81. The closure device set forth in claim 76, wherein the first and second barbs include an inclined surface and an edge and the first and second notches include an inclined surface and an edge.

82. The closure device set forth in claim 81, wherein the edges of the barbs engage the edges of the notches to substantially prevent removal of the appendages from the slots when the first and second housing segments are in the first and second assembly positions.

83. A closure device comprising:

interlocking fastening strips; and a slider member slidably disposed on the interlocking fastening strips, the slider member facilitating the occlusion of said fastening strips when moved towards a first end thereof and facilitating the deocclusion of said fastening strips when moved towards a second end thereof, the slider member having a first housing segment, a second housing segment, and an attachment mechanism for use in assembling the first and second housing segments together onto the interlocking fastening strips, the attachment mechanism comprising a first appendage projecting from the first housing segment and a first slot formed in the second housing segment, said first appendage having a first barb formed along its length and said first slot having a first notch formed along its length, said first slot of the attachment mechanism receiving said first appendage of the attachment mechanism when the first and second housing segments are moved together while said first barb interacts with said first notch to provide a first assembly position for the first and second housing segments, wherein said first barb includes a pair of opposed inclined surfaces and a pair of opposed edges and said first notch includes a pair of opposed inclined surfaces and a pair of opposed edges.

84. The closure device set forth in claim 83, wherein the opposed edges of said first barb engage the opposed edges of said first notch to substantially prevent removal of said first appendage from said first slot when the first and second housing segments are in the first assembly position.

* * * * *